US010660501B2

(12) United States Patent
Racs et al.

(10) Patent No.: US 10,660,501 B2
(45) Date of Patent: May 26, 2020

(54) DOMESTIC DISHWASHER

(71) Applicant: BSH Hausgeräte GmbH, Munich (DE)

(72) Inventors: Florian Racs, Heidenheim (DE); Simon Heilig, Ulm (DE); Ralf Winkler, Wittislingen (DE); Robert Gutekunst, Finningen (DE)

(73) Assignee: Hausgeräte GmbH, Munich (DE)

( * ) Notice: Subject to any disclaimer, the term of this patent is extended or adjusted under 35 U.S.C. 154(b) by 0 days.

(21) Appl. No.: 16/320,499

(22) PCT Filed: Sep. 8, 2017

(86) PCT No.: PCT/EP2017/072560

§ 371 (c)(1),
(2) Date: Jan. 25, 2019

(87) PCT Pub. No.: WO2018/054699

PCT Pub. Date: Mar. 29, 2018

(65) Prior Publication Data

US 2019/0261829 A1 Aug. 29, 2019

(30) Foreign Application Priority Data

Sep. 20, 2016 (DE) ..... 10 2016 217 940

(51) Int. Cl.
*A47L 15/50* (2006.01)

(52) U.S. Cl.
CPC ..... *A47L 15/507* (2013.01); *A47L 15/50* (2013.01)

(58) Field of Classification Search
CPC ..... A47L 15/507; A47L 15/50; A47B 88/493; A47B 2210/0059; A47B 2210/0043;
(Continued)

(56) References Cited

U.S. PATENT DOCUMENTS 3,466,109 A * 9/1969 Kauffman ..... A47L 15/504 312/228.1
3,594,058 A * 7/1971 Kauffman ..... A47L 15/507 312/298
(Continued)

FOREIGN PATENT DOCUMENTS

DE 743047 C 12/1943
DE 10163866 A1 7/2003
(Continued)

OTHER PUBLICATIONS

English machine translation of DE102010036314 (Year: 2011).*
National Search Report DE 10 2016 217 940.3 dated Aug. 8, 2017.

*Primary Examiner* — Hiwot E Tefera
(74) *Attorney, Agent, or Firm* — Michael E. Tschupp; Andre Pallapies; Brandon G. Braun

(57) ABSTRACT

A household dishwasher includes a washing container, a receptacle for items to be washed, and a guide device configured to enable movement of the receptacle into and out of the washing container. The guide device includes a running rail and a locking element which is configured to fix the receptacle to the running rail when the receptacle is moved out of the washing container until the running rail is in a state in which it is moved completely out of the washing container. The locking element releases the receptacle when the running rail is in the state in which it is moved completely out of the washing container, thereby bringing the receptacle into a state in which the receptacle is moved completely out of the washing container.

21 Claims, 14 Drawing Sheets

(58) Field of Classification Search
CPC ..... A47B 88/487; A47B 2210/0016; A47B 2210/0081; A47B 2210/007; A47B 88/57; A47B 88/40; A47B 2210/17
USPC ..... 211/41.8; 312/311, 334.33, 228.1, 312/334.44
See application file for complete search history.

(56) References Cited

U.S. PATENT DOCUMENTS 3,761,153 A * 9/1973 Guth ..... A47L 15/507 312/351
3,822,085 A * 7/1974 Clark ..... A47L 15/504 312/351
3,982,802 A * 9/1976 Bailey ..... A47L 15/507 312/228.1
4,692,035 A * 9/1987 Rock ..... A47B 88/493 312/334.44
4,912,727 A * 3/1990 Schubert ..... F16C 29/00 248/206.5
4,988,214 A * 1/1991 Clement ..... A47B 88/493 312/333
6,238,031 B1 * 5/2001 Weng ..... A47B 88/407 312/333
6,752,478 B1 6/2004 Francz
6,942,307 B1 * 9/2005 Lammens ..... A47B 88/57 312/334.1
2005/0001524 A1 * 1/2005 Deiss ..... A47L 15/504 312/334.4
2006/0078235 A1 * 4/2006 Chen ..... A47B 88/493 384/18
2015/0190034 A1 * 7/2015 Jeong ..... A47L 15/507 312/228.1
2015/0305493 A1 * 10/2015 Garcia ..... A47B 46/005 211/86.01
2016/0058266 A1 * 3/2016 Nygren ..... A47L 15/507 312/228.1

FOREIGN PATENT DOCUMENTS

DE 10218064 A1 12/2003
DE 102010036314 A1 5/2011
DE 102013211554 A1 12/2014
EP 1321093 A2 6/2003
EP 1323372 A2 7/2003
EP 1356758 A2 10/2003

* cited by examiner

DOMESTIC DISHWASHER

CROSS-REFERENCES TO RELATED APPLICATIONS

This application is the U.S. National Stage of International Application No. PCT/EP2017/072560, filed Sep. 8, 2017, which designated the United States and has been published as International Publication No. WO 2018/054699 A1 and which claims the priority of German Patent Application, Serial No. 10 2016 217 940.3, filed Sep. 20, 2016, pursuant to 35 U.S.C. 119(a)-(d).

BACKGROUND OF THE INVENTION

The present invention relates to a household dishwasher.

A household dishwasher has a washing container and at least one receptacle for items to be washed, it being possible for said receptacle to be moved into or out of said washing container. In particular such a household dishwasher can have several receptacles for items to be washed, which are arranged one above the other, for example a lower rack, an upper rack or a flatware rack. The receptacles for items to be washed are supported in the washing container with the aid of guide devices. Such a guide device can have rollers fastened to the washing container, which roll along a running rail that can be moved into and out of the washing container. Further rollers can also be provided on the receptacle for items to be washed, being designed to roll along the movable running rail. The receptacle for items to be washed can then be moved into and out of the washing container in a telescopic manner with the aid of the guide device.

The publication EP 1 321 093 A2 discloses a roller guide for containers in household appliances, in particular dishwashers, that can be moved out in particular in the manner of a drawer, with a rail, at least one roller running in the rail and an entry region arranged at one end of the rail, which is configured to be flexible in relation to the roller so that it can receive it in an at least partially play-free manner.

The publication DE 101 63 866 A1 discloses a roller guide for containers in household appliances, in particular dishwashers, that can be moved out in particular in the manner of a drawer. It comprises a rail, at least one roller running in the rail and a first entry region arranged at the end of the rail to receive a roller axis in an at least partially play-free manner. The first entry region here can be configured as flexible and/or gripping in relation to the roller axis. The first entry region can also be configured as a slot and/or the first entry region can have a constriction acting perpendicular to the roller axis.

The publication DE 10 2010 036 314 A1 discloses a roller guide for a container that can be moved out of a household appliance, in particular a dishwasher. It comprises at least one pair of guide rails, at least two guide rollers in each guide rail, allowing movement of the rail relative to the appliance, and at least one roller on each guide rail, allowing rolling movement of the container in relation to the guide rail, with at least one latching means for latching the guide rail to the guide roller being arranged on at least one of the guide rails. At least one retaining means, which acts independently of the latching means and prevents the rolling movement of at least one roller on the guide rail, is arranged on at least one of the guide rails. The retaining means for preventing rolling movement of at least one roller that can be moved on the guide rail can be configured as elevations arranged on the guide rail and rising on both sides. The roller can also be fixed in an end position by the elevation and/or the rise of the elevation can be greater on the side of the elevation away from the washing chamber than the rise on the side of the elevation facing the washing chamber.

BRIEF SUMMARY OF THE INVENTION

Against this background it is one object of the invention to provide an improved household dishwasher.

A household dishwasher is therefore proposed with a washing container, a guide device and a receptacle for items to be washed, it being possible for said receptacle to be moved into and out of the washing container of the household dishwasher with the aid of the guide device, the guide device having a running rail and a locking element, which is designed to fix the receptacle for items to be washed to the running rail when said receptacle is moved out of the washing container until the running rail is in a state in which it is moved completely out of the washing container and which is designed to release the receptacle for items to be washed when the running rail is in the state in which it is moved completely out of the washing container, in order to bring the receptacle for items to be washed itself into a state in which it is moved completely out of the washing container.

The receptacle for items to be washed can therefore be moved out of the washing container in particular in two stages. In a first stage only the running rail is moved, the receptacle for items to be washed being fixed to the running rail. In a second step the receptacle for items to be washed is released and moves along the running rail, while the running rail itself is fixed. Because the running rails of two guide devices of a receptacle for items to be washed are always moved synchronously out of the washing container first, a constantly low pull-out force can be achieved, as the receptacle for items to be washed cannot tilt as it moves out of the washing container. Also the fixing of the receptacle for items to be washed to the running rail ensures that the receptacle for items to be washed can be moved out of the washing container in a smooth and steady manner.

The state in which the running rail is moved completely out of the washing container is defined as a state from which the running rail cannot be moved further out of the washing container. In particular in this state a roller of the guide device rests against an end cap of the running rail. However when the running rail is in the state in which it is moved completely out of the washing container, it can still be located partially within the washing container. The state in which the receptacle for items to be washed is moved completely out of the washing container is defined as a state from which the receptacle for items to be washed cannot be moved further out of the washing container. In particular when it is in its state in which it is moved completely out of the washing container, the receptacle for items to be washed is arranged completely outside the washing container, so that it can be loaded and unloaded easily.

According to one embodiment the guide device has first rollers, which are fastened rotatably to the washing container and which are preferably arranged within the running rail, and second rollers, which are fastened rotatably to the receptacle for items to be washed, the first rollers and second rollers rolling in or on the running rail respectively, when the receptacle for items to be washed is moved out of the washing container and when the receptacle for items to be washed is moved into the washing container.

Two first rollers are preferably provided, being fastened rotatably to a fastening plate. The fastening plate is fastened to a side wall of the washing container, for example being screwed, riveted or welded thereto. The guide device has three second rollers, two of the second rollers rolling along the top of the running rail and one of the second rollers rolling along the bottom of the running rail.

The second rollers are preferably arranged outside the guide rail. The guide rail is preferably made of a metal material. The rollers can be made of a plastic material. The running rail has a C-shaped cross-section.

According to a further embodiment the locking element has a stop segment, against which one of the first rollers comes to a stop to release the receptacle for items to be washed.

The stop segment is guided through an aperture provided in the running rail. This allows the locking element, which is preferably configured as an end cap, to be connected to the running rail with a form fit. When the running rail is moved out of the washing container, it is moved out until one of the first rollers comes to a stop against the stop segment. When the receptacle for items to be washed is pulled further out of the washing container, the running rail no longer moves but the locking element releases the second roller, which then rolls along the running rail, in order to move the receptacle for items to be washed completely out of the washing container.

According to a further embodiment the locking element is designed to engage around one of the second rollers with a form fit to fix the receptacle for items to be washed to the running rail when said receptacle is moved out of the washing container.

The second rollers preferably have a concave running surface. The locking element is designed to engage in the concave running surface.

According to a further embodiment the locking element has an elastically deformable engagement segment to engage around the second roller with a form fit.

The engagement segment is preferably made of an elastically deformable material, in particular plastic.

According to a further embodiment the engagement segment is designed to engage at least partially around a running surface of the second running surface.

As mentioned above, the second running surface has a concave running surface, in which the engagement segment engages. The roller also has two flanks arranged one opposite the other.

According to a further embodiment the engagement segment is curved in an arched manner, in particular in the manner of a circular arc, and preferably brush-like.

The geometry of the engagement segment allows a fixing force to be established, which has to be overcome when the receptacle for items to be washed is moved out of the washing container.

The engagement segment preferably has a plurality of bristles, which extend in the direction of the running surface of the second roller. The bristles are elastically deformable.

According to a further embodiment the engagement segment is designed to engage laterally in a flank of the second roller.

The engagement segment is preferably designed to engage in the flank of the second roller with a form fit.

According to a further embodiment the locking element comprises two engagement segments, which are designed to engage in both sides of the flank of the second roller.

This increases a force which is required to release the second roller.

According to one embodiment the locking element has at least one preferably flexible element to fix the receptacle for items to be washed to the running rail when said receptacle is moved out of the washing container, said element being designed to engage at least partially with a form fit behind an indentation configured on the receptacle for items to be washed.

A locking element configured as a preferably flexible element, which is designed to engage at least partially with a form fit behind an indentation configured on the receptacle for items to be washed has the advantage that the same part is used for the left guide device and the right guide device. Also it has no significantly protruding parts so the locking elements do not become entangled during transport and can therefore be transported loose in containers. The locking elements can also be assembled more easily and the risk of damage to a locking element is largely avoided. The locking element is not in any direct contact with the roller, so the lack of contact means there is no possible disadvantage due to contact.

According to one embodiment the indentation is configured or formed on a device for adjusting the height of the receptacle for items to be washed, on a contour of the receptacle for items to be washed or by a preferably vertical rack wire of the receptacle for items to be washed.

The locking element configured as a preferably flexible element can touch, in particular engage behind, the receptacle for items to be washed, an additional module of the receptacle for items to be washed or even an additional part of the receptacle for items to be washed in principle anywhere. The use of an indentation on a device for adjusting the height of the receptacle for items to be washed, a contour of the receptacle for items to be washed or a preferably vertical rack wire of the receptacle for items to be washed is advantageous in respect of structure, functionality, operational reliability and cost.

According to a further embodiment the locking element is positioned on an end segment of the guide rail and connected thereto with a form fit.

An aperture is preferably provided on the end segment, in which the stop segment of the locking element engages with a form fit.

According to a further embodiment the locking element is a single-piece plastic part, in particular an injection molded plastic part.

This allows the locking element to be produced economically in large numbers.

According to a further embodiment the household dishwasher comprises two guide devices, which are provided on opposing side walls of the washing container.

The guide devices are preferably connected to the side walls with the aid of the first rollers. The first rollers are connected rotatably to fastening plates, which in turn are screwed, riveted or welded to the respective side wall of the washing container.

According to a further embodiment the household dishwasher comprises several receptacles for items to be washed, each receptacle for items to be washed being assigned two guide devices.

For example the household dishwasher can have three receptacles for items to be washed, in particular a lower rack, an upper rack and a flatware drawer, it being possible for each of said receptacles for items to be washed to be assigned two such guide devices.

Further possible implementations of the household dishwasher comprise combinations of features or embodiments described above or in the following with regard to the exemplary embodiments even if these are not cited specifically. The person skilled in the art will also add individual aspects to improve or complete the respective basic form of the household dishwasher.

BRIEF DESCRIPTION OF THE DRAWINGS

Further advantageous configurations and aspects of the household dishwasher are set out in the subclaims and the exemplary embodiments of the household dishwasher described in the following. The household dishwasher is also described in more detail based on preferred embodiments with reference to the accompanying figures, in which:

DETAILED DESCRIPTION OF EXEMPLARY EMBODIMENTS OF THE PRESENT INVENTION

Figure 1:
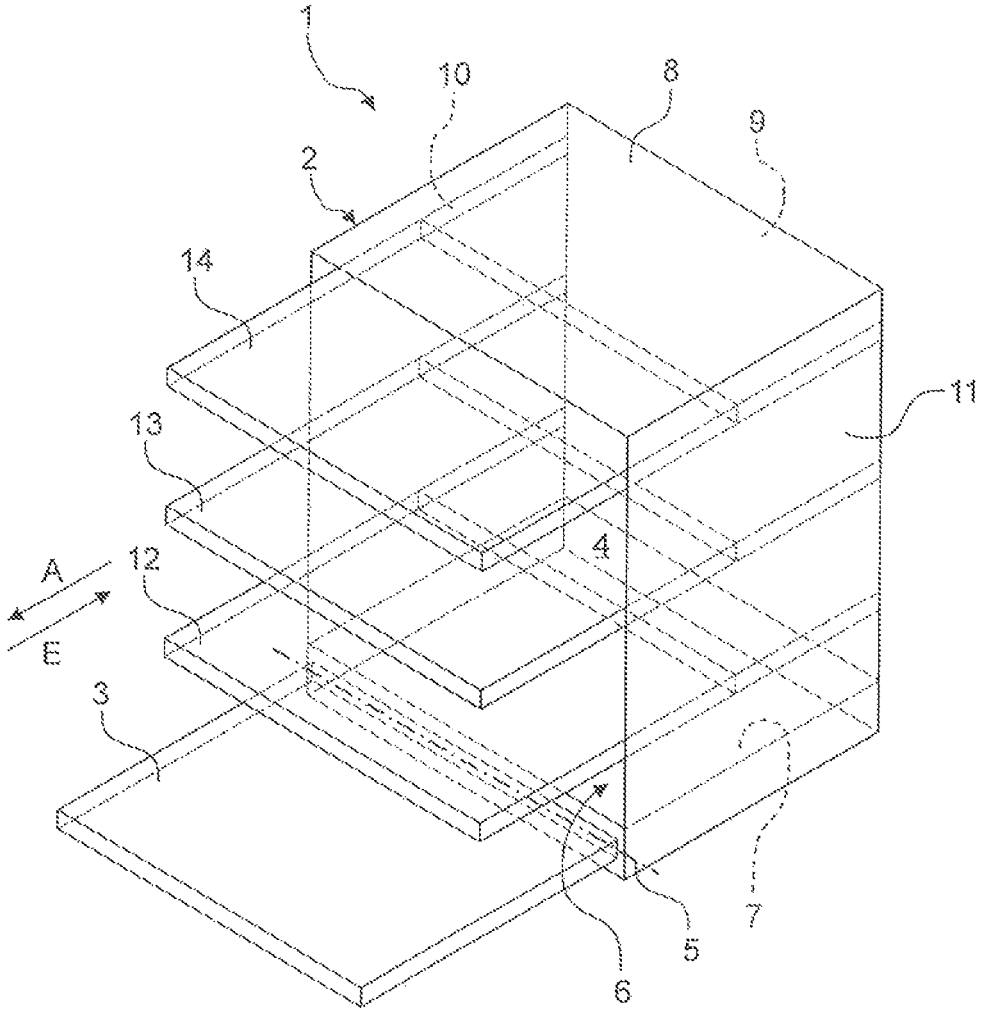
FIG. 1 shows a schematic perspective view of an embodiment of a household dishwasher.

Identical elements or those of identical function are shown with the same reference characters in the figures, unless otherwise specified.

FIG. 1 shows a schematic perspective view of an embodiment of a household dishwasher 1. The household dishwasher 1 comprises a washing container 2, which can be closed, in particular in a water-tight manner, by a door 3. A sealing facility can be provided for this purpose between the door 3 and the washing container 2. The washing container 2 is preferably box-shaped. The washing container 2 can be arranged in a housing of the household dishwasher 1. The washing container 2 and door 3 can form a washing chamber 4 for washing items to be washed.

The door 3 is shown in its opened position in FIG. 1. The door 3 can be closed or opened by pivoting about a pivot axis 5 provided at a lower end of the door 3. A loading opening 6 of the washing container 2 can be closed or opened with the aid of the door 3. The washing container 2 has a base 7, a top 8 arranged opposite the base 7, a rear wall 9 arranged opposite the closed door 3 and two opposingly arranged side walls 10, 11. The base 7, top 8, rear wall 9 and side walls 10, 11 can be made of stainless steel sheet for example. Alternatively the base 7 for example can be made of a plastic material.

The household dishwasher 1 also has at least one receptacle 12 to 14 for items to be washed. Several, for example three, receptacles 12 to 14 for items to be washed can preferably be provided, the receptacle 12 being a lower receptacle for items to be washed or a lower rack, the receptacle 13 being an upper receptacle for items to be washed or an upper rack and the receptacle 14 being a flatware drawer. As also shown in FIG. 1, the receptacles 12 to 14 for items to be washed are arranged one above the other in the washing container 2. Each receptacle 12 to 14 for items to be washed can be moved into the washing container 2 or out of it as required. In particular each receptacle 12 to 14 for items to be washed can be pushed into the washing container in an insertion direction E (arrow) and out of the washing container 2 counter to the insertion direction E (arrow) in a pull-out direction A (arrow). Two guide devices (not shown in FIG. 1) can be assigned to each receptacle 12 to 14 for items to be washed to move said receptacles 12 to 14 for items to be washed out and in.

Figure 2:
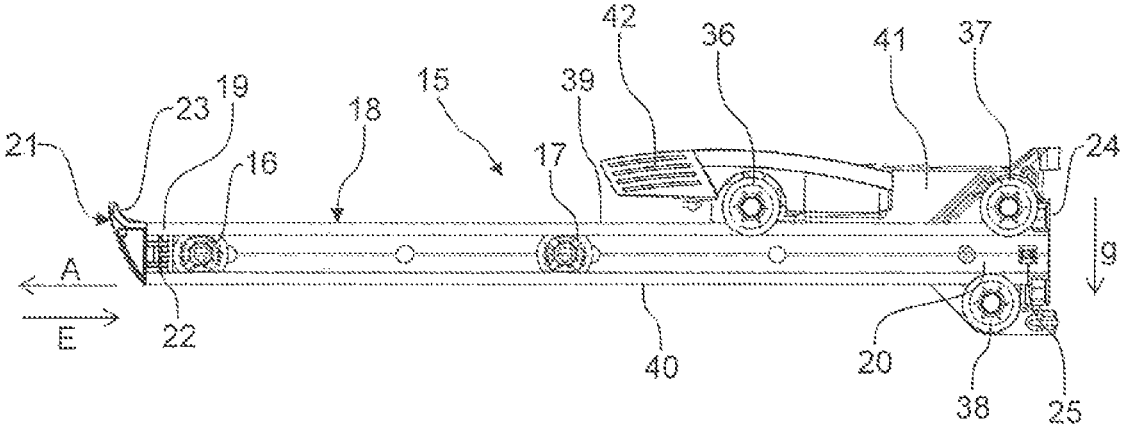
FIG. 2 shows a schematic side view of a guide device for the household dishwasher according to FIG. 1.

FIG. 2 shows a schematic side view of an embodiment of a guide device 15 for the receptacle 13 for items to be washed. However the guide device 15 is also suitable for the receptacles 12 or 14 for items to be washed. Only the receptacle 13 for items to be washed is examined in the following. The receptacle 13 for items to be washed is assigned two such guide devices 15, which are fastened to the opposing side walls 10, 11 of the washing container 2. The guide device 15 has two first rollers 16, 17. There can be any number of first rollers 16, 17. However at least two such first rollers 16, 17 are provided. The first rollers 16, 17 are fastened rotatably to the washing container 2, in particular to one of the side walls 10, 11. A fastening plate can be provided for this purpose, the first rollers 16, 17 being supported rotatably thereon. The fastening plate is then screwed, welded or riveted to one of the side walls 10, 11. In other words the first rollers 16, 17 are fastened in a fixed position in the washing container 2.

The guide device 15 also comprises a running rail 18, which has a C-shaped cross-section. The first rollers 16, 17 are arranged in the running rail 18. The running rail 18 can be pulled out of the washing container 2 in the pull-out direction A (arrow) and can be pushed into the washing container 2 in the insertion direction E (arrow), the first rollers 16, 17 rolling in the running rail 18. The running rail 18 has a first end segment 19 and a second end segment 20 facing away from the first end segment 19.

An end cap 21 is positioned on the first end segment 19, closing off the end face of the first end segment 19. The end cap 21 is preferably connected to the first end segment 19 with a form fit. A form-fit connection results when at least two connecting pieces engage in or behind one another. The end cap 21 can have snap hooks for example, to connect it to the first end segment 19. The end cap 21 has a terminating segment 22, which is arranged within the running rail 18 and serves as a stop, in other words an end position, for one of the first rollers 16, 17, in particular for the first roller 16. The end cap 21 also has an end segment 23 protruding upward over the running rail 18 and this can be curved, in particular in the manner of a circular arc.

Figure 3:
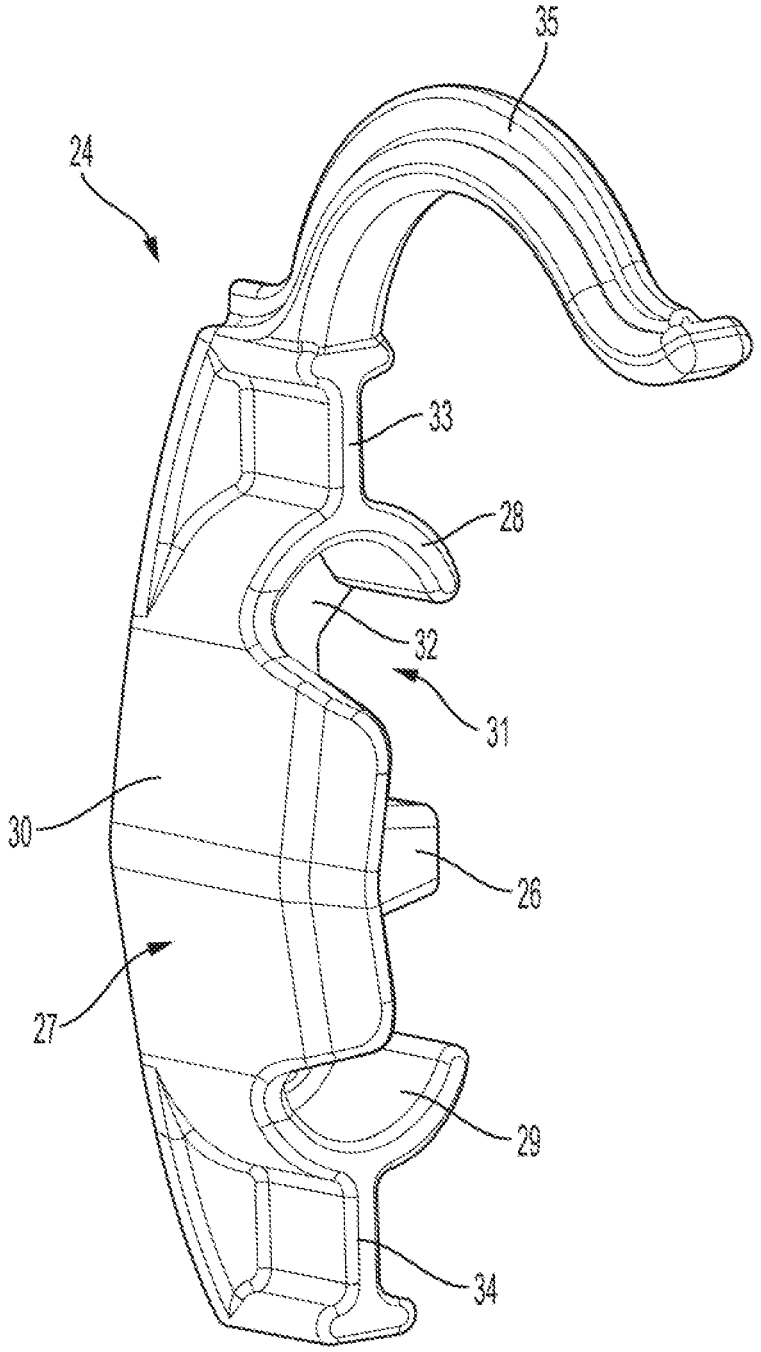
FIG. 3 shows a schematic perspective view of an embodiment of a locking element for the guide device according to FIG. 2.

A further end cap, in particular a locking element 24, of the guide device 15 is provided on the second end segment 20 of the running rail 18. The locking element 24 shown in FIG. 3 is preferably a single-piece plastic part, in particular an injection molded plastic part. The locking element 24 is positioned on the second end segment 20 of the running rail 18 and connected thereto with a form fit. To this end an aperture 25 can be provided on the second end segment 20 of the running rail 18, into which a stop segment 26 of the locking element 24 engages with a form fit.

The locking element 24 comprises a base body 27, which has a C-shaped cross-section like the running rail 18. The base body 27 has two opposing curved projections 28, 29, arranged as mirror images of one another and connected to one another on one side by a closed wall 30. On the other side the base body 27 has an opening 31. The locking element 24 can be snapped onto the second end segment 20 of the running rail 18 using the opening 31.

The stop segment 26 protrudes out of the wall 30 at the front, in other words in the direction of the opening 31. The base body 27 also has a rear wall 32, against which the second end segment 20 of the running rail 18 rests when the guide device 15 is in the assembled state. The base body 27 is open opposite the rear wall 32. Two T-shaped ribs 33, 34, arranged as mirror images of one another, are provided on the outside of the base body 27. An elastically deformable engagement segment 35 extends from one of the ribs 33. The engagement segment 35 is curved in an arched manner, in particular in the manner of a circular arc.

Returning to FIG. 2, the guide device 15 also comprises several second rollers 36 to 38. Two second rollers 36, 37 are arranged above the running rail 18 in relation to the direction of gravity g (arrow), being designed to roll on the running rail 18, and one of the second rollers 38 is arranged below the running rail 18 in relation to the direction of gravity g (arrow). Unlike the first rollers 16, 17, the second rollers 36 to 38 are not arranged within the running rail 18 but outside the running rail 18. Two second rollers 36, 37 here are designed to roll along an upper face 39 of the running rail 18 and one of the second rollers 38 is designed to roll along a lower face 40 of the running rail 18.

The second rollers 36 to 38 are fastened rotatably to a fastening plate 41. The fastening plate 41 is connected in turn to the receptacle 13 for items to be washed. In other words the second rollers 36 to 38 are coupled to the receptacle 13 for items to be washed by way of the fastening plate 41. A height adjuster is also provided, having an actuation lever 42, which can be used to move the receptacle 13 for items to be washed upward counter to the direction of gravity g (arrow) or downward in the direction of gravity g (arrow) in relation to the running rail 18. This allows the receptacle 13 for items to be washed to be customized based on the height of the items to be washed.

FIG. 2 shows the running rail 18 in an initial state in which it is moved completely into the washing container 2, in which the first roller 16 rests against the end cap 21 and the second roller 37 rests against the rib 33. In this initial state the engagement segment 35 of the locking element engages at least partially around the second roller 37. The engagement segment 35 is arranged in such a manner that it engages around the second roller 37 in the center of its diameter, it being possible to select an angle of contact freely based on the required retaining force.

Figure 4:
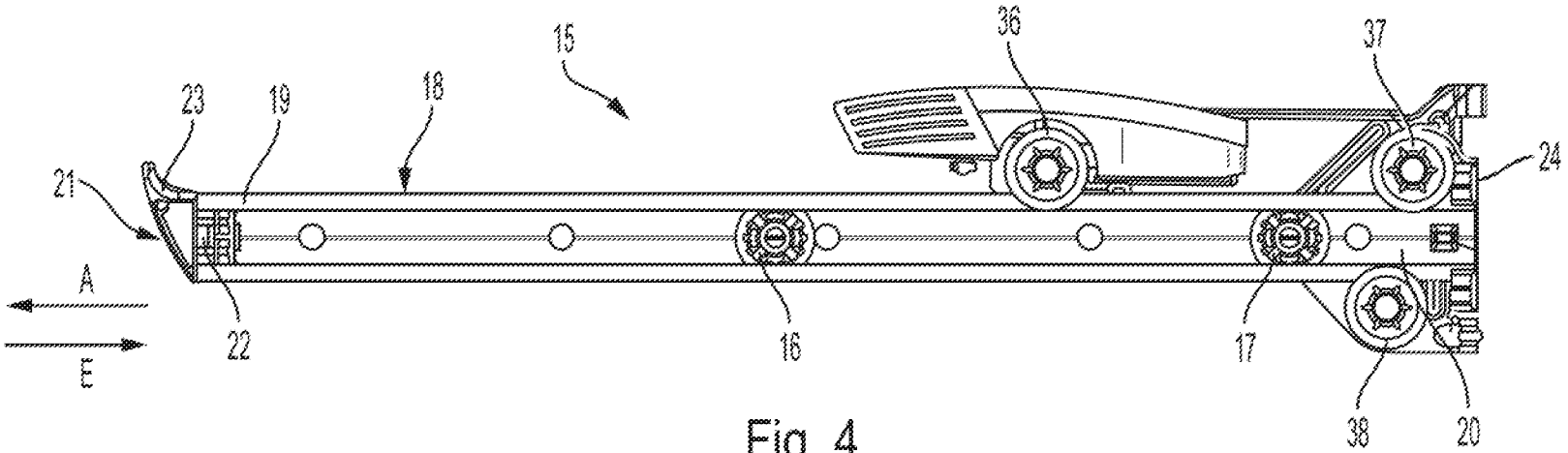
FIG. 4 shows a further schematic side view of the guide device according to FIG. 2.
Figure 5:
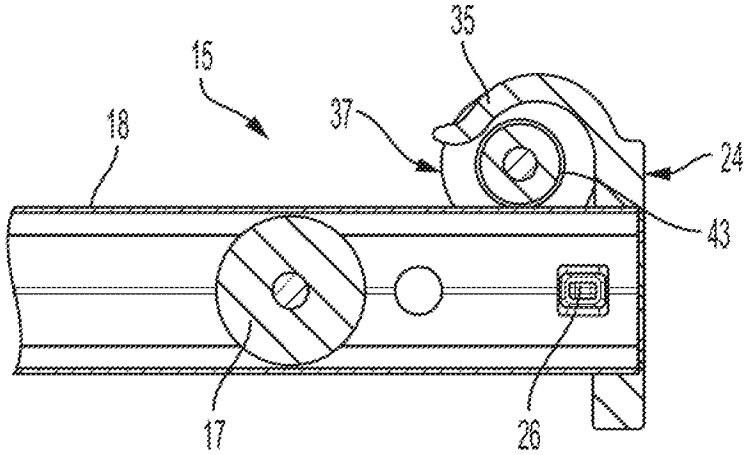
FIG. 5 shows a detailed view of FIG. 4.

The mode of operation of the guide device 15 is described in the following based on FIGS. 2 to 9. From the initial state shown in FIG. 2, in which the first roller 16 rests against the end cap 21 and the engagement segment 35 of the locking element engages around the second roller 37, the receptacle 13 for items to be washed is moved out of the washing container 2 in the pull-out direction A (arrow). In this process the first rollers 16, 17 run along within the running rail 18, as shown in FIGS. 4 and 5. The engagement segment 35 still engages around the second roller 37, as shown in FIG. 5. In other words, when the receptacle 13 for items to be washed is moved out of the washing container 2 in the pull-out direction A (arrow), the first rollers 16, 17 initially run along the inside of the running rail 18, with the result that it is moved out of the washing container 2 along with the receptacle 13 for items to be washed. The second rollers 36 to 38 however do not yet run along the top and bottom of the running rail 18, as the second roller 37 is locked with the aid of the engagement segment 35. The second rollers 36 to 38 have a concave running surface 43, into which the engagement segment 35 engages. In FIGS. 4 and 5 the running rail 18 is in an intermediate state between the initial state and a state in which it is moved completely out of the washing container 2.

Figure 6:
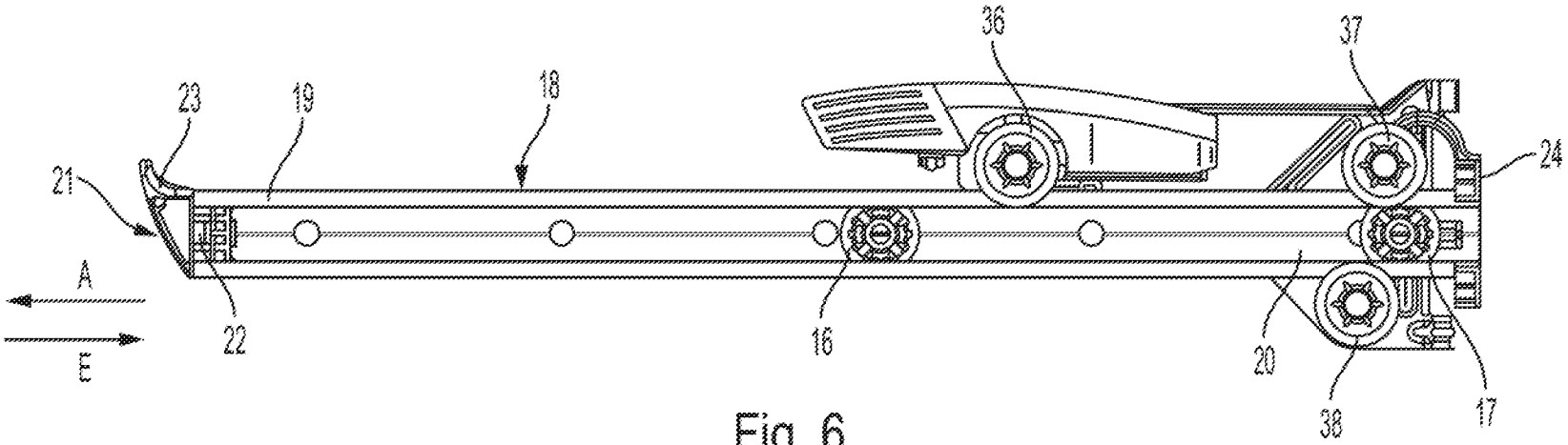
FIG. 6 shows a further schematic view of the guide device according to FIG. 2.
Figure 7:
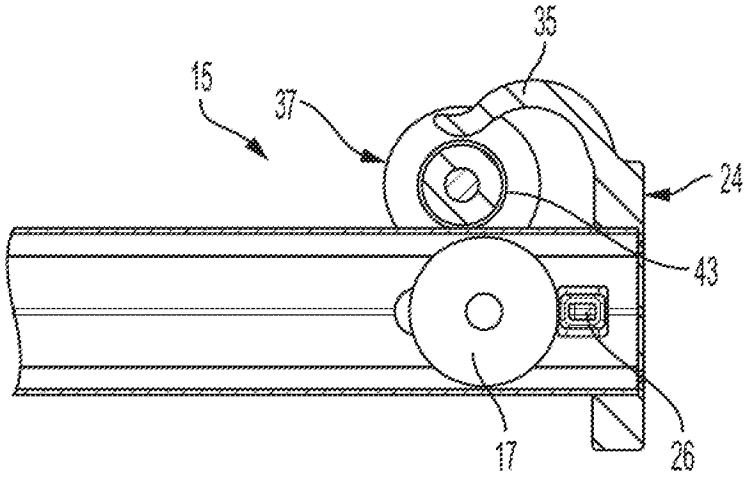
FIG. 7 shows a detailed view of FIG. 6.

When the receptacle 13 for items to be washed is moved further out of the washing container 2, as shown in FIGS. 6 and 7, the first roller 17 comes up against the stop segment 26 of the locking element 24. The state in which the first roller 17 rests against the stop segment 26 represents a state in which the running rail 18 is moved completely out of the washing container 2. In other words the running rail 18 cannot be pulled further out of the washing container 2 in the pull-out direction A (arrow) from the completely moved out state shown in FIGS. 6 and 7.

However if a further pull-out force is applied to the receptacle 13 for items to be washed, the engagement segment 35 of the locking element 24 deforms elastically, as shown in FIG. 7, thereby releasing the second roller 37. The receptacle 13 for items to be washed can now be pulled completely out of the washing container 2 in the pull-out direction A (arrow), with the second rollers 36 to 38 running along the top and bottom of the running rail 18. The upper receptacle 13 for items to be washed can then be pulled out of the washing container until the second roller 36 comes into contact with the end segment 23 of the end cap 21.

Figure 8:
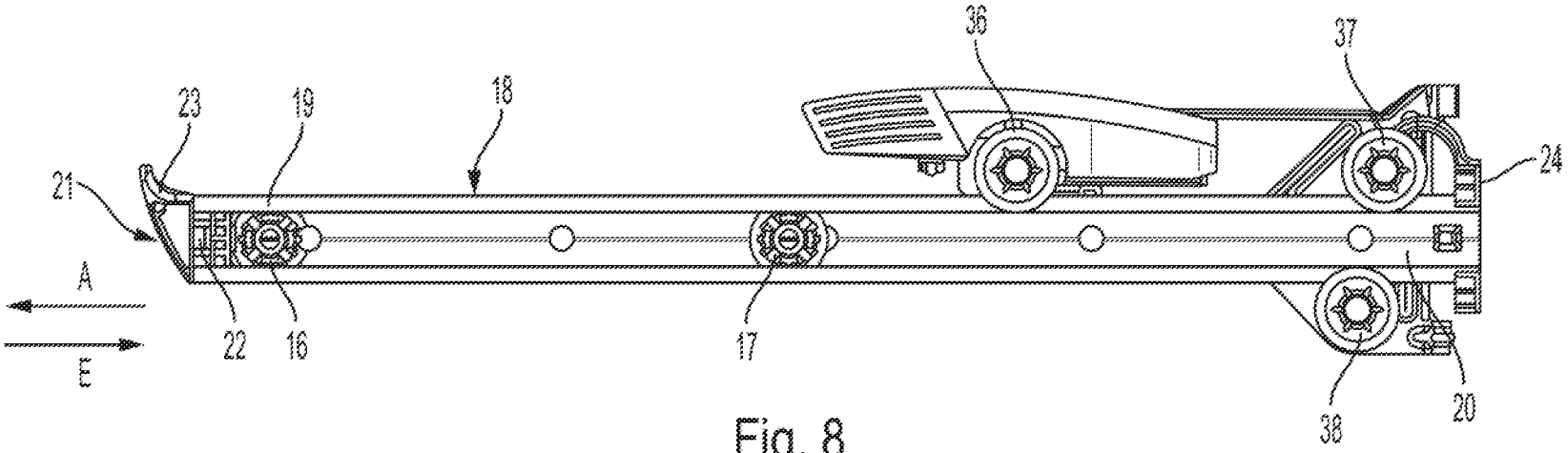
FIG. 8 shows a further schematic side view of the guide device according to FIG. 2.
Figure 9:
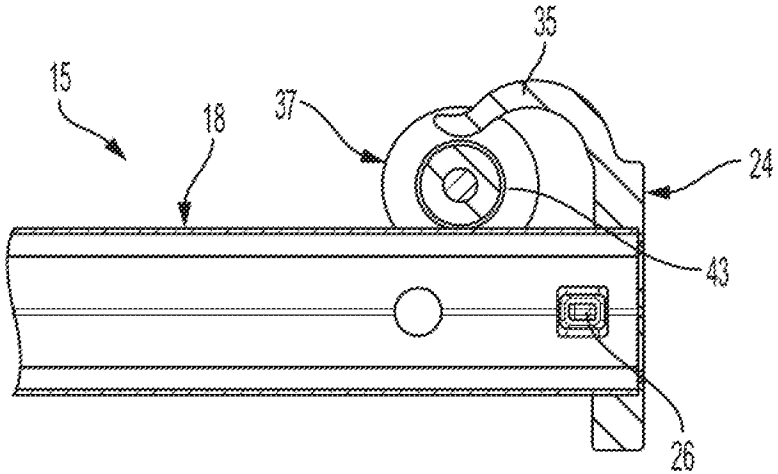
FIG. 9 shows a detailed view of FIG. 8.

FIGS. 8 and 9 show the receptacle 13 for items to be washed moving into the washing container 2 in the insertion direction E. When the receptacle 13 for items to be washed moves into the washing container 2, the first rollers 16, 17 run along the inside of the running rail 18 and the second rollers 36 to 38 run along the top and bottom of the running rail 18. The running rail 18 is pushed into the washing container 2 until the first roller 16 comes up against the end cap 21. When the receptacle 13 for items to be washed is pushed further into the washing container 2 in the insertion direction E (arrow), the engagement segment 35 of the locking element 24 is elastically deformed, with the result that it engages around the second roller 37 with a form fit again and fixes the receptacle 13 for items to be washed to the running rail 18.

Figure 10:
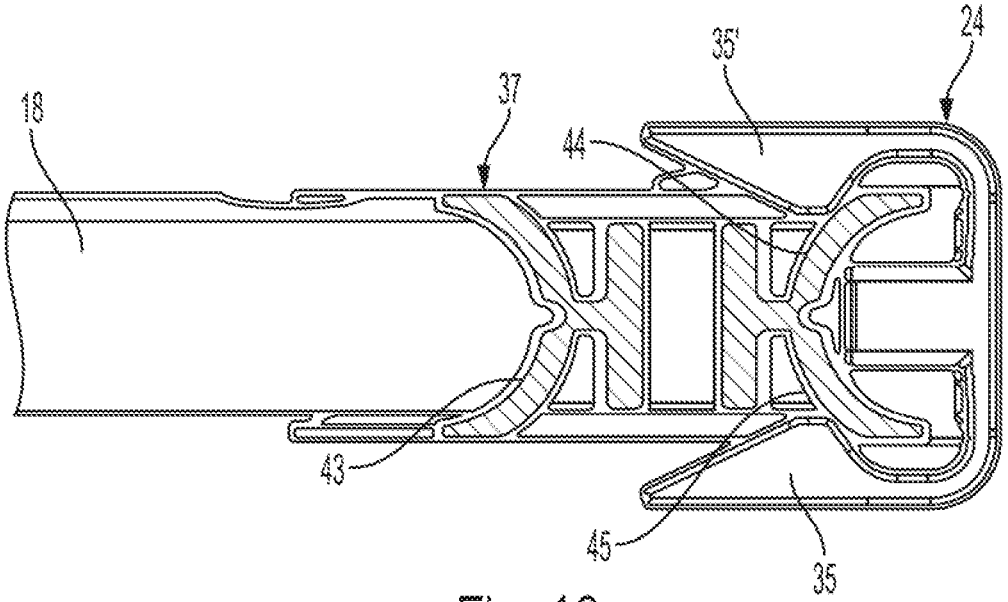
FIG. 10 shows a schematic top view of a further embodiment of a locking element for the guide device according to FIG. 2.
Figure 11:
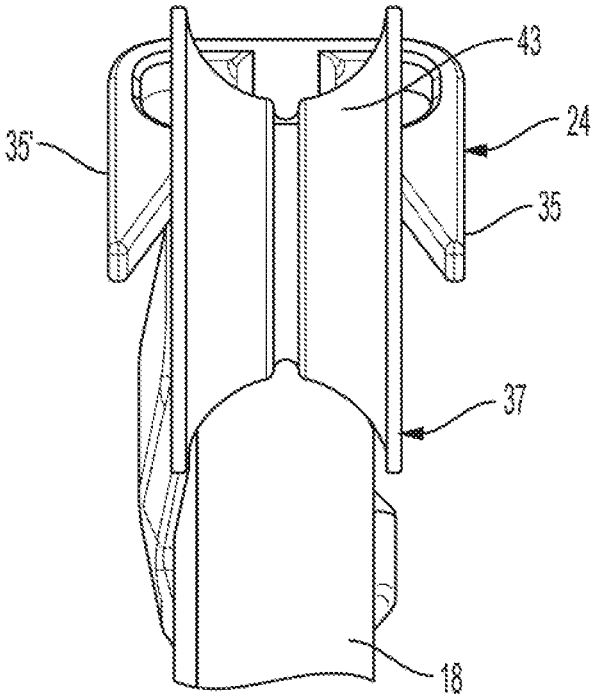
FIG. 11 shows a schematic perspective view of the locking element according to FIG. 10.

FIGS. 10 and 11 show a further embodiment of a locking element 24. In this embodiment the locking element 24 has two engagement segments 35, 35', which are designed to engage with a form fit in both sides of a flank 44, 45 of the second roller 37 respectively.

Figure 12:
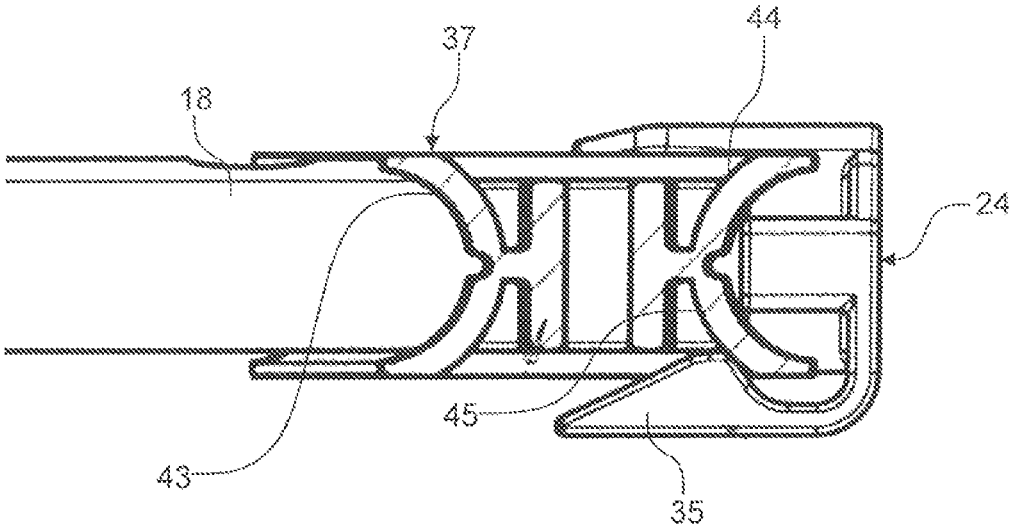
FIG. 12 shows a schematic top view of a further embodiment of a locking element for the guide device according to FIG. 2.
Figure 13:
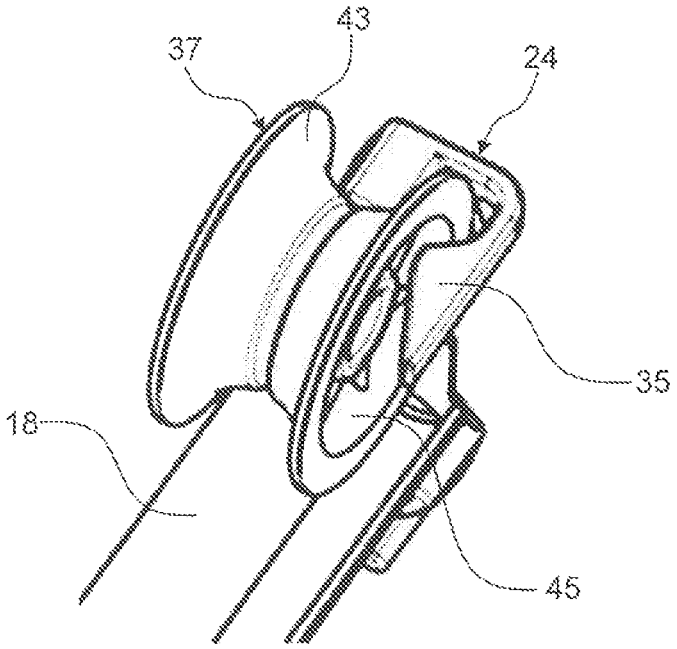
FIG. 13 shows a schematic perspective view of the locking element according to FIG. 12.

FIGS. 12 and 13 show a further embodiment of a locking element 24. The locking element 24 according to FIGS. 12 and 13 differs from the locking element 24 according to FIGS. 10 and 11 in that it only has one engagement segment 35, which is designed to engage laterally with a form fit in one of the flanks 44, 45 of the second roller 37.

Figure 14:
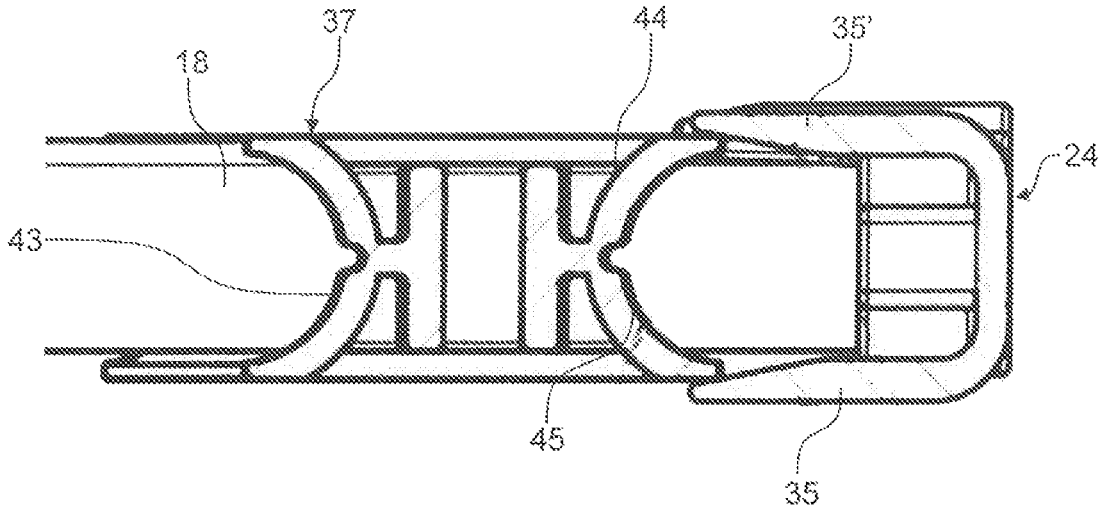
FIG. 14 shows a schematic top view of a further embodiment of a locking element for the guide device according to FIG. 2.
Figure 15:
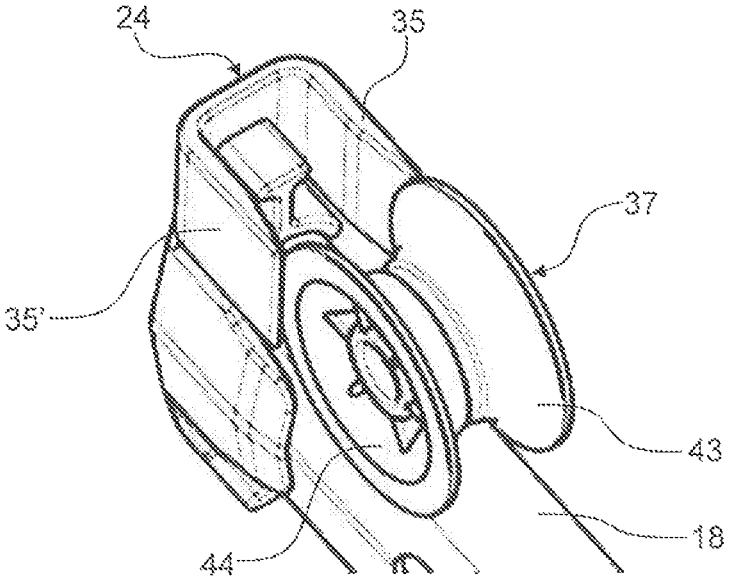
FIG. 15 shows a schematic perspective view of the locking element according to FIG. 14.

FIGS. 14 and 15 show a further embodiment of a locking element 24. In this embodiment the locking element 24 comprises two engagement segments 35, 35', which engage laterally around the second roller 37.

Figure 16:
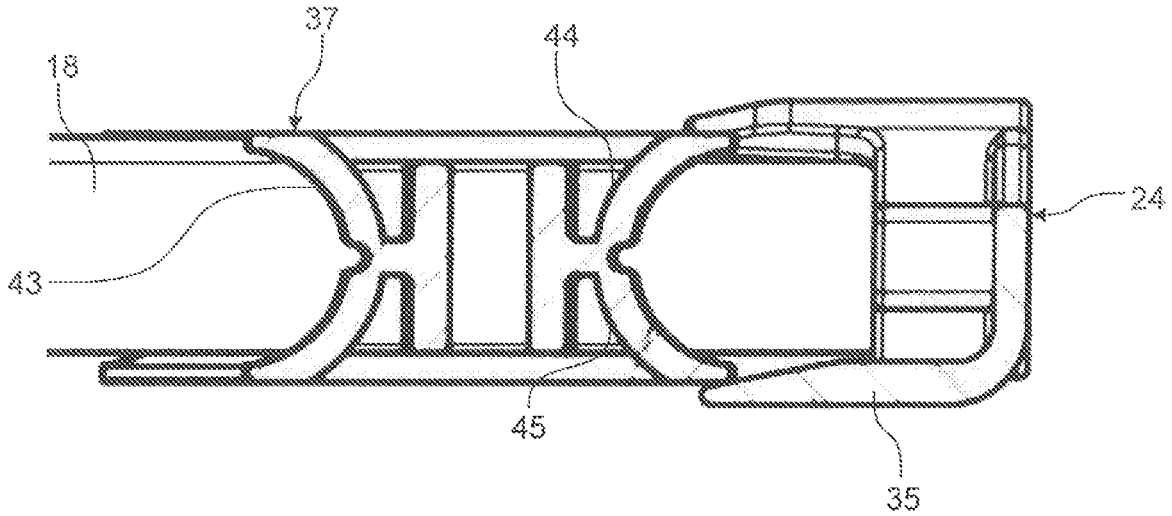
FIG. 16 shows a schematic top view of a further embodiment of a locking element for the guide device according to FIG. 2.
Figure 17:
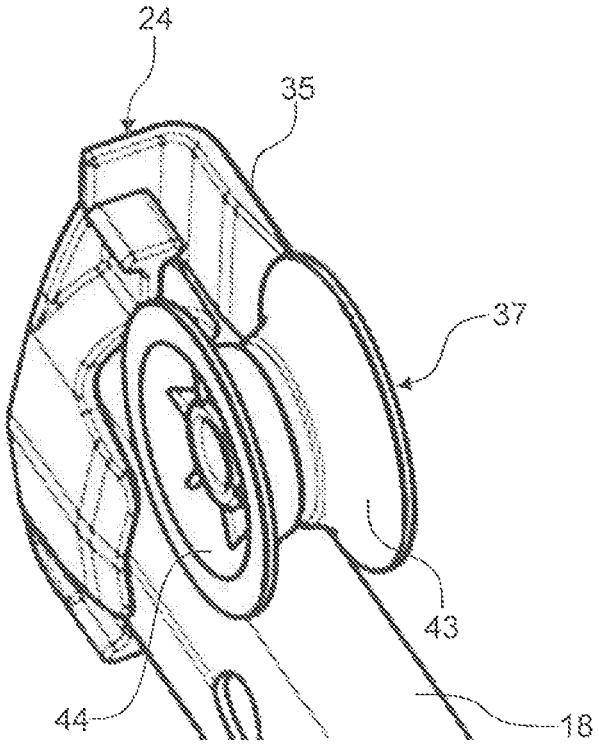
FIG. 17 shows a schematic perspective view of the locking element according to FIG. 16.

FIGS. 16 and 17 show a further embodiment of a locking element 24. The embodiment of the locking element 24 according to FIGS. 16 and 17 only differs from the embodiment of the locking element 24 according to FIGS. 14 and 15 in that the locking element 24 only has one engagement segment 35, which engages laterally around the second roller 37.

Figure 18:
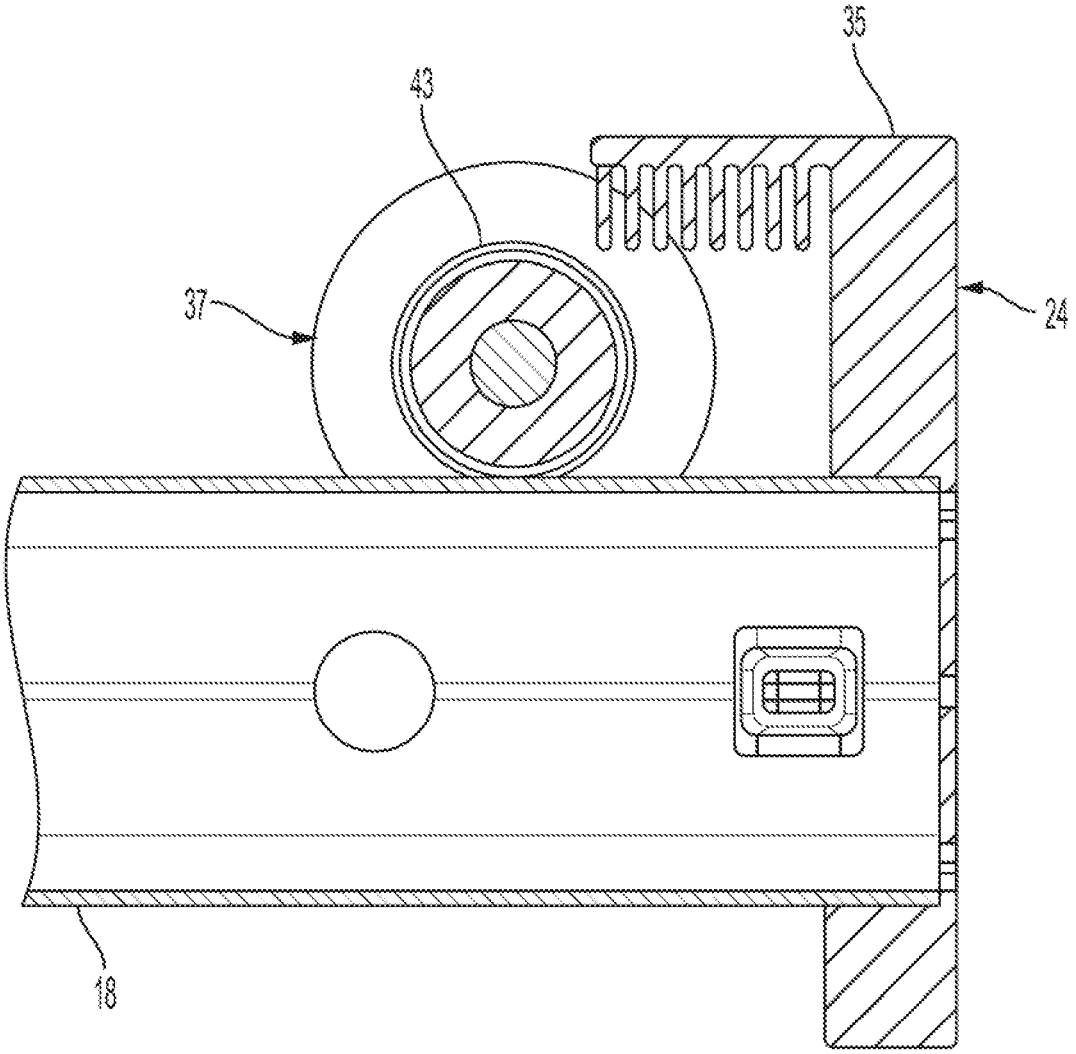
FIG. 18 shows a schematic side view of an embodiment of a locking element for the guide device according to FIG. 2.
Figure 19:
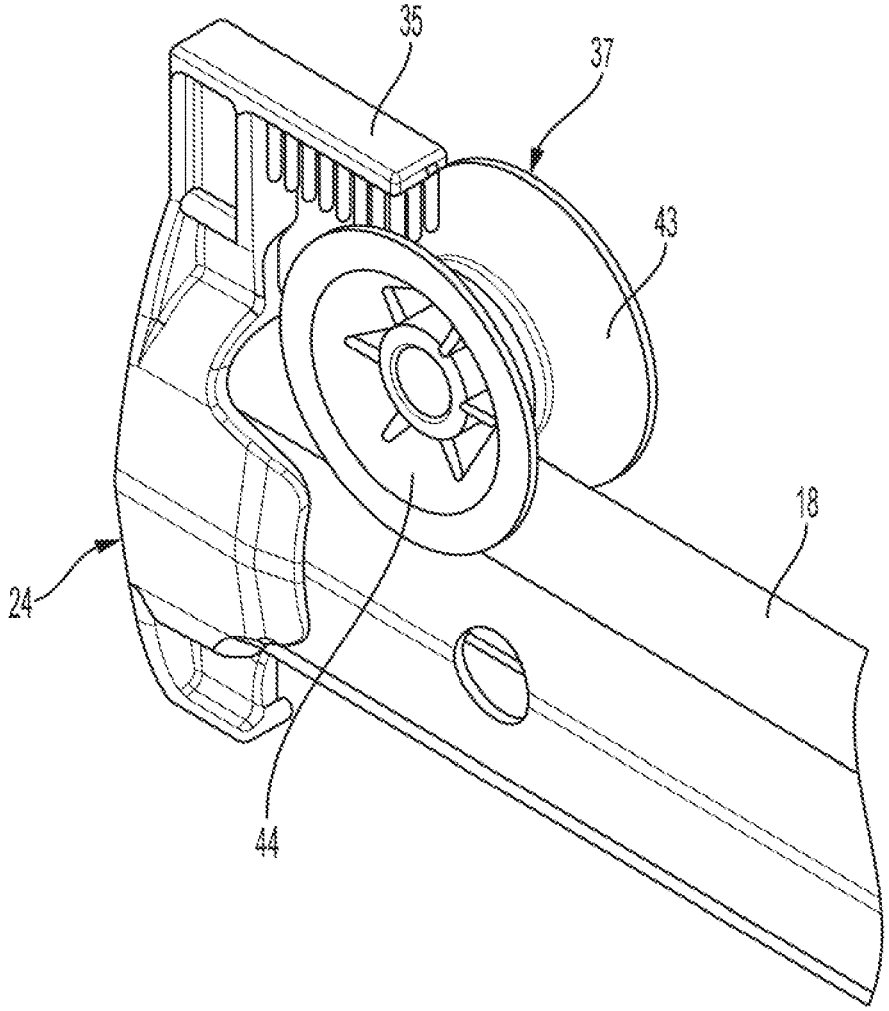
FIG. 19 shows a schematic perspective view of the locking element according to FIG. 18.

FIGS. 18 and 19 show a further embodiment of a locking element 24. In this embodiment of the locking element 24 the engagement segment 35 is configured in the manner of a brush and engages in the running surface 43 of the second roller 37.

Figure 20:
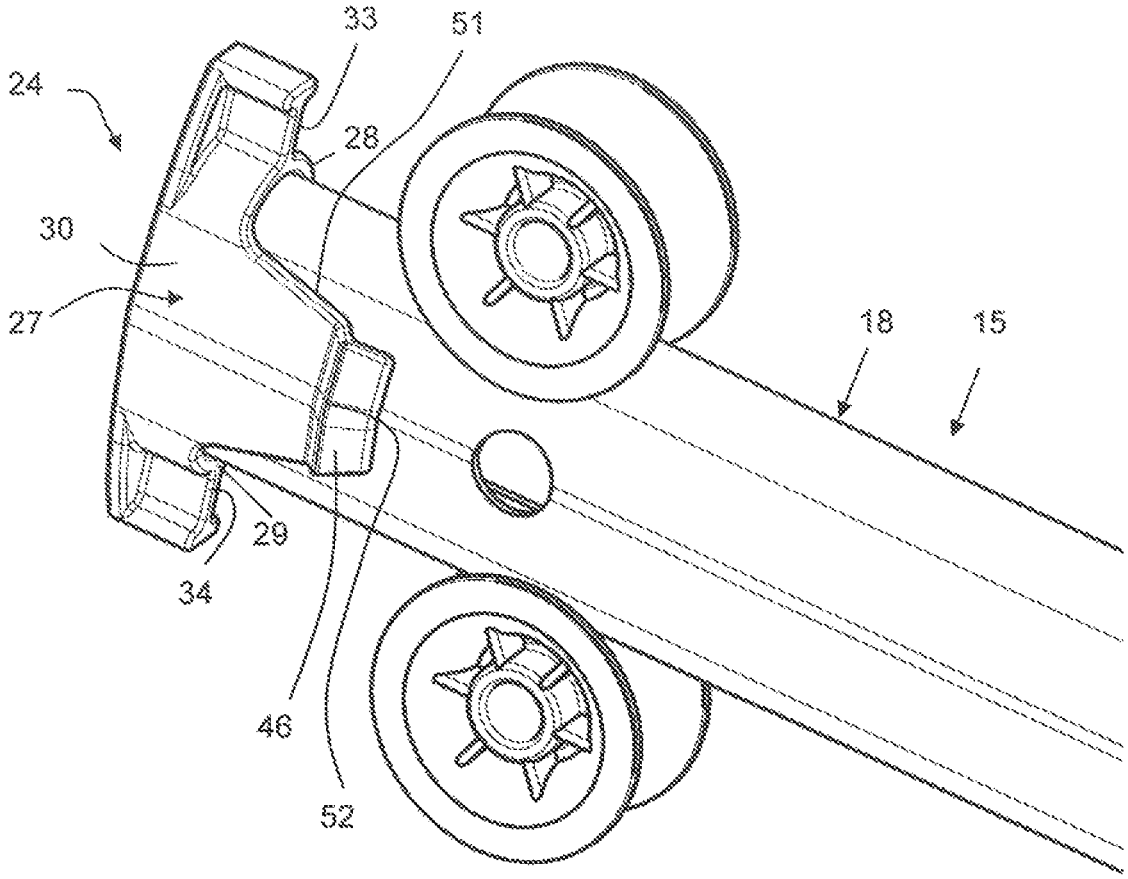
FIG. 20 shows a schematic perspective view of a further embodiment of a locking element for the guide device according to FIG. 2.

FIG. 20 shows a schematic perspective view of a further embodiment of a locking element 24 for the guide device 15 according to FIG. 2.

Provided on the second end segment 20 of the running rail 18 (see FIG. 2) is a further end cap, in particular a locking element 24 for fixing the receptacle 12 to 14 for items to be washed to the guide device 15 when said receptacle 12 to 14 is moved out of the washing container 2 (see FIG. 1). The locking element 24 is preferably a single-piece plastic part, in particular an injection molded plastic part. The locking element 24 is positioned on the second end segment 20 of the running rail 18 and connected thereto with a form fit. To this end an aperture 25 can be provided on the second end segment 20 of the running rail 18, into which a stop segment 26 of the locking element 24 engages with a form fit (see FIG. 3).

The locking element 24 comprises a base body 27, which has a C-shaped cross-section like the running rail 18. The base body 27 has two opposing curved projections 28, 29, arranged as mirror images of one another and connected to one another on one side by a closed wall 30. On the other side the base body 27 has an opening 31 (see FIG. 3). The locking element 24 can be snapped onto the second end segment 20 of the running rail 18 using the opening 31.

Figure 21:
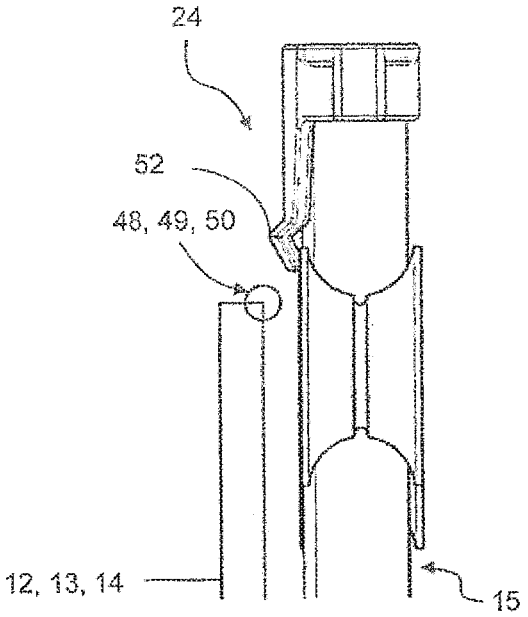
FIG. 21 shows a schematic top view of the further embodiment of the locking element for the guide device according to FIG. 20.
Figure 22:
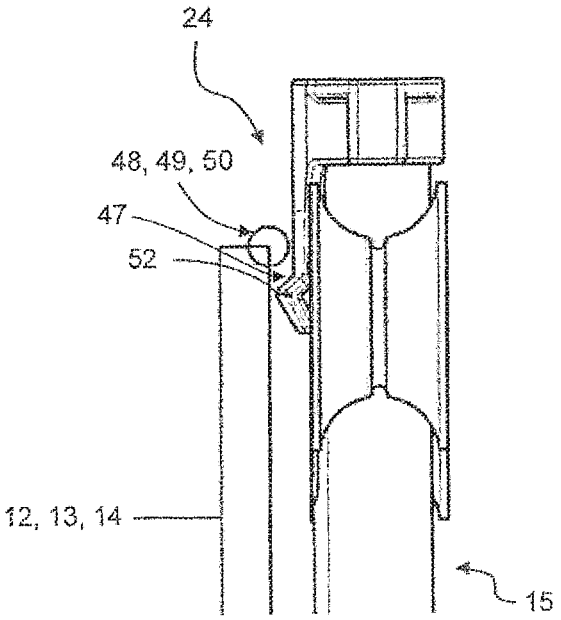
FIG. 22 shows a further schematic top view of the further embodiment of the locking element for the guide device according to FIG. 20.

The locking element 24 has at least one flexible element 46, which is designed to engage at least partially with a form fit behind an indentation 47 configured on the receptacle 12 to 14 for items to be washed (see FIGS. 21 and 22). The flexible element 46 has an essentially tongue-shaped basic contour 51 and is positioned on the base body 27 at one side. An elevation 52 is located in the region of the essentially tongue-shaped basic contour 51 of the flexible element 46 facing away from the base body 27, causing it to engage behind the indentation 47 configured on the receptacle 12 to 14 for items to be washed as a function of the position of the receptacle 12 to 14 for items to be washed.

The stop segment 26 protrudes from the wall 30 at the front, in other words in the direction of the opening 31. The base body 27 also has a rear wall 32, against which the second end segment 20 of the running rail 18 rests when the guide device 15 is in the assembled state. The base body 27 is open opposite the rear wall 32. Two T-shaped ribs 33, 34, arranged as mirror images of one another, are provided on the outside of the base body 27.

The two FIGS. 21 and 22 each show a schematic top view of the further embodiment of the locking element 24 for the guide device 15 according to FIG. 20. In the diagram in FIG. 21 the receptacle 12 to 14 for items to be washed is in a freely movable position, while in FIG. 22 it is in an engaged, therefore locked position (end position).

The indentation 47, which can engage at least partially with a form fit behind the elevation 52 of the flexible element 46 of the locking element 24, is preferably configured or formed on a device 48 for adjusting the height of the receptacle 12 to 14 for items to be washed, on a contour 49 of the receptacle 12 to 14 for items to be washed or by a preferably vertical rack wire 50 of the receptacle 12 to 14 for items to be washed. As the respective element 48, 49, 50 provided with the indentation 47 is known to the person skilled in the art, it is only shown schematically.

The main advantage of the guide device 15 is that it ensures that the running rails 18 of two of the guide devices 15 assigned to the receptacle 13 for items to be washed are always moved synchronously out of the washing container 2 first. This results in constantly low pull-out forces, as the receptacle 13 for items to be washed cannot jam when it is moved out of the washing container 2. Also because the second rollers 37 are fixed on the receptacle 13 for items to be washed, any juddering or jerking is reduced as the receptacle 13 for items to be washed is pulled out until the second roller 37 is released.

Even though the present invention has been described with reference to exemplary embodiments, it can be modified in many different ways.

The invention claimed is:

1. A household dishwasher, comprising:

a washing container;

a receptacle for items to be washed; and a guide device configured to enable movement of the receptacle into and out of the washing container, said guide device including a running rail and a locking element configured to fix the receptacle to the running rail when the receptacle is moved out of the washing container such that the running rail first moves out of the washing container until the running rail is in a state in which it is moved completely out of the washing container, said locking element configured to release the receptacle when the running rail is in the state in which it is moved completely out of the washing container such that the receptacle then moves with respect to the running rail further out of the washing container, thereby bringing the receptacle into a state in which the receptacle is moved completely out of the washing container, wherein the guide device includes first rollers fastened rotatable to the washing container, and second rollers fastened rotatable to the receptacle, said first and second rollers rolling in or on the running rail, when the receptacle is moved out of the washing container and when the receptacle is moved into the washing container.

2. The household dishwasher of claim 1, wherein the first rollers are arranged within the running rail.

3. The household dishwasher of claim 1, wherein the locking element includes a stop segment, which is impacted by one of the first rollers to release the receptacle.

4. The household dishwasher of claim 1, wherein the locking element is configured to engage around one of the second rollers with a form fit to fix the receptacle to the running rail when the receptacle is moved out of the washing container.

5. The household dishwasher of claim 4, wherein the locking element has an elastically deformable engagement segment to engage around the one of the second rollers with the form fit.

6. The household dishwasher of claim 5, wherein the engagement segment engages at least partially around a running surface of the one of the second rollers.

7. The household dishwasher of claim 5, wherein the engagement segment is curved in an arched manner.

8. The household dishwasher of claim 5, wherein the engagement segment is curved in a manner of a circular arc.

9. The household dishwasher of claim 5, wherein the engagement segment has a shape of a brush.

10. The household dishwasher of claim 5, wherein the engagement segment engages laterally in a flank of the one of the second rollers.

11. The household dishwasher of claim 10, wherein the locking element has two of said elastically deformable engagement segment to engage in both sides of the flank of the one of the second rollers.

12. The household dishwasher of claim 1, wherein the locking element includes an element to fix the receptacle to the running rail when the receptacle is moved out of the washing container, said element engaging at least partially with a form fit behind an indentation on the receptacle.

13. The household dishwasher of claim 12, wherein the element is flexible.

14. The household dishwasher of claim 12, further comprising a device connected to the receptacle and configured to adjust a height of the receptacle, said indentation being formed on the device on a contour of the receptacle or by a rack wire of the receptacle.

15. The household dishwasher of claim 14, wherein the rack wire extends vertically.

16. The household dishwasher of claim 1, wherein the locking element is positioned on an end segment of the running rail and connected thereto with a form fit.

17. The household dishwasher of claim 1, wherein the locking element is a single-piece injection molded plastic part.

18. The household dishwasher of claim 1, further comprising a further one of said guide device, wherein the guide device and the further guide device are provided on opposing side walls of the washing container.

19. The household dishwasher of claim 1, further comprising a plurality of said receptacle, and a plurality of said guide device, each of the plurality of receptacles being operably connected to two of the plurality of guide devices.

20. A household dishwasher, comprising:

a washing container;

a receptacle for items to be washed; and a guide device configured to enable movement of the receptacle into and out of the washing container, said guide device including a running rail and a locking element configured to fix the receptacle to the running rail when the receptacle is moved out of the washing container until the running rail is in a state in which it is moved completely out of the washing container, said locking element configured to release the receptacle when the running rail is in the state in which it is moved completely out of the washing container, thereby bringing the receptacle into a state in which the receptacle is moved completely out of the washing container, wherein the guide device includes first rollers fastened rotatably to the washing container, and second rollers fastened rotatably to the receptacle, said first and second rollers rolling in or on the running rail, when the receptacle is moved out of the washing container and when the receptacle is moved into the washing container, and wherein the locking element has an elastically deformable engagement segment that is configured to engage around one of the second rollers with a form fit to fix the receptacle to the running rail when the receptacle is moved out of the washing container.

21. A household dishwasher, comprising:

a washing container;

a receptacle for items to be washed; and a guide device configured to enable movement of the receptacle into and out of the washing container, said guide device including a running rail and a locking element configured to fix the receptacle to the running rail when the receptacle is moved out of the washing container until the running rail is in a state in which it is moved completely out of the washing container, said locking element configured to release the receptacle when the running rail is in the state in which it is moved completely out of the washing container, thereby bringing the receptacle into a state in which the receptacle is moved completely out of the washing container, wherein the locking element includes an element to fix the receptacle to the running rail when the receptacle is moved out of the washing container, said element engaging at least partially with a form fit behind an indentation on the receptacle, and further comprising a device connected to the receptacle and configured to adjust a height of the receptacle, said indentation being formed on the device on a contour of the receptacle or by a rack wire of the receptacle.

* * * * *